US008266735B2

(12) United States Patent
McLeod

(10) Patent No.: US 8,266,735 B2
(45) Date of Patent: Sep. 18, 2012

(54) OVERFLOW DEVICE ASSEMBLY WITH SLIDING FACEPLATE

(75) Inventor: Christopher Adam McLeod, Toronto (CA)

(73) Assignee: Oakville Stamping & Bending Ltd. (CA)

( * ) Notice: Subject to any disclaimer, the term of this patent is extended or adjusted under 35 U.S.C. 154(b) by 380 days.

(21) Appl. No.: 12/270,876

(22) Filed: Nov. 14, 2008

(65) Prior Publication Data

US 2010/0122411 A1 May 20, 2010

(51) Int. Cl.
*E04H 4/00* (2006.01)

(52) U.S. Cl. ..... 4/494; 4/679

(58) Field of Classification Search ..... 4/694, 680, 4/668, 683, 688

See application file for complete search history.

(56) References Cited

U.S. PATENT DOCUMENTS 4,796,310 A 1/1989 Freville et al.
4,886,210 A * 12/1989 Gaffney et al. ..... 4/678
5,123,123 A * 6/1992 Hart et al. ..... 4/694
5,890,241 A 4/1999 Ball
6,173,459 B1 * 1/2001 Ball ..... 4/683
6,216,288 B1 * 4/2001 Bernau ..... 4/694
6,295,664 B2 * 10/2001 Fritz et al. ..... 4/694
6,669,492 B1 * 12/2003 McIlvenna ..... 439/135
6,916,989 B2 * 7/2005 Broussard, Jr. ..... 174/66
7,007,319 B2 * 3/2006 Dunnett et al. ..... 4/694
7,094,969 B1 8/2006 In
7,237,280 B1 * 7/2007 Holden et al. ..... 4/694
2003/0192115 A1 * 10/2003 Oropallo et al. ..... 4/694
2004/0107497 A1 * 6/2004 Hirtriter ..... 4/694
2008/0028514 A1 * 2/2008 Lock et al. ..... 4/613
2008/0098517 A1 * 5/2008 Ball ..... 4/694

* cited by examiner

*Primary Examiner* — Gregory Huson
*Assistant Examiner* — Karen L Younkins
(74) *Attorney, Agent, or Firm* — Harness, Dickey & Pierce, P.L.C.

(57) ABSTRACT

An overflow device assembly for a vessel such as a bathtub or sink is provided. The overflow device comprises a tieplate comprising a mating flange attached to a first end of a pipe and a faceplate operable to slide onto the tieplate. The faceplate comprises a front cover portion, a backside and a groove. The pipe is operable to be concentrically disposed with a hole in a wall of the vessel. The groove is located on the backside of the faceplate, and the mating flange slides along and inside the groove. Once in place, the front cover portion of the faceplate covers the first end of the pipe.

8 Claims, 4 Drawing Sheets

OVERFLOW DEVICE ASSEMBLY WITH SLIDING FACEPLATE

FIELD OF THE INVENTION

This invention relates to an overflow device assembly for a vessel, and more particularly to an overflow device assembly incorporating a faceplate.

BACKGROUND OF THE INVENTION

A bath or sink, herein "vessel", is drained by a "waste-overflow" bath drain assembly. The upper portion of this assembly consists of an "elbow ", sometimes called a "head fitting", which is fastened to the vessel wall by a "tieplate" fastened by a variety of means through the overflow hole in the vessel wall into the elbow on the outer vessel wall. Common tieplate shapes include a simple tiebar across the width of the overflow hole, and round plates with bolt holes.

In the early days of plumbed baths, a perforated metal plate was fastened to this tieplate by means of a bolt which might also bear a chain suspending a plug. This fastened plate was called a "faceplate". This terminology stuck even when the faceplate was deepened into a cup, the perforations moving off the vertical face plane to the bottom of the cup rim, out of aesthetic sight. Ball (U.S. Pat. No. 5,890,241: Apr. 6, 1999) is an example of a bolt-on faceplate.

Other means of securing the faceplate to the tieplate include snap-on faceplates (Dunnett U.S. Pat. No. 7,007,319: Mar. 7, 2006), hinged faceplate (Freville U.S. Pat. No. 4,796,310: Jan. 10, 1989), and faceplates secured with a set screw (Ball U.S. Pat. No. 6,173,459: Jan. 16, 2001). Often the attachment is integral to some more complex drain functionality.

While not related to waste-overflow bath drain assemblies, a mating slot and tab can be found in McIlvenna (U.S. Pat. No. 6,669,492: Dec. 30, 2003) and in In (U.S. Pat. No. 7,094,969: Aug. 22, 2006).

Covering the overflow hole with a faceplate performs mainly an aesthetic function. Indeed, an open overflow without a faceplate would provide the best functionality for the drainage functions of the overflow hole; namely, (1) The overflow hole serves as a pressure relief vent when the water drains out of the waste drain in the bottom of the vessel. This avoids having the water being siphoned out of the water trap that is plumbed between the vessel drain and the pipe to the primary sanitary drain. Maintenance of water in this water trap is essential for preventing sewer gases from travelling upward into the vessel.

(2) The overflow hole mitigates overflowing of liquid over the brim of the vessel, hence its name.

(3) The overflow hole provides access to the household drain system as it permits the passing of a "snake" by the plumber to clear blockages. In general, contemporary tieplates and tiebars that fasten the rear elbow to the bath have (or consist of) a cross bar to which the faceplate is fastened. This prevents plumber snake access. Temporarily unscrewing the faceplate is not an option as the elbow would fall off behind the vessel.

Nonetheless, in most vessel installations the user of the vessel has come to expect that the overflow hole be discretely covered by a faceplate, though even frontal perforations became unacceptable, leading to the evolution of the cup shaped faceplate with perforations on the rim underneath.

SUMMARY OF THE INVENTION

Accordingly, it is an object of this invention to at least partially overcome some of the disadvantages of the prior art.

In a preferred embodiment, a tieplate is annular in shape, with a flat flange hugging to the inner side of the vessel. The internal circumference of this annular flange bears an externally or male threaded short pipe which passes through the overflow hole, through a water seal gasket, and then threads into an internal or female thread within the elbow.

In a preferred embodiment, a slot is interior and rear to a faceplate, and a mating flange on the tieplate that runs concentrically and circumferentially to the main flange has sufficient clearance from a vessel wall to allow the grooved faceplate to fit over this mating flange of the tieplate.

In a preferred embodiment, a novel faceplate-tieplate sub-assembly is designed wherein the faceplate is operable to slide over and onto the tieplate of a sink or bath drain assembly by means of a slot fitting over a mating flange. This sub-assembly covers the overflow hole of the vessel. Although simple, this sub-assembly enables all three of the overflow drainage functionalities to be realized; namely:

1) Retention of functionality as an air relief vent.
2) Retention of liquid overflow mitigation.
3) Preservation of snake access to clear blockages in the drain.

Additionally, using a slide-on faceplate brings the following benefits:

4) No fastener is required to attach the faceplate to the tieplate.
5) Indentations can be moulded around the inner circumference of the tieplate to capture the chain ball and suspend a chain and plug for the vessel waste drain, meaning the faceplate can be removed without disturbing the chain, if a chain and plug are indeed selected as to be the waste drain closure.
6) The faceplate is free to be shaped, patterned, or designed in any manner, no longer having a screw hole through its center or needing to accommodate snap features or hinges.

Accordingly, in at least one aspect, this invention resides in an overflow device assembly for a vessel comprising a tieplate comprising a mating flange attached to a first end of a pipe, wherein the pipe is operable to be concentrically disposed with a hole in a wall of the vessel; and a faceplate operable to slide onto the tieplate, wherein the faceplate comprises a front cover portion, a backside and a groove, wherein the groove is located on the backside of the faceplate, and wherein the mating flange slides along and inside the groove and the front cover portion of the faceplate covers the first end of the pipe.

Further aspects of the invention will become apparent upon reading the following detailed description and drawings, which illustrate the invention and preferred embodiments of the invention.

BRIEF DESCRIPTION OF THE DRAWINGS

In the drawings, which illustrate embodiments of the invention.

DETAILED DESCRIPTION OF THE INVENTION

Figure 1:
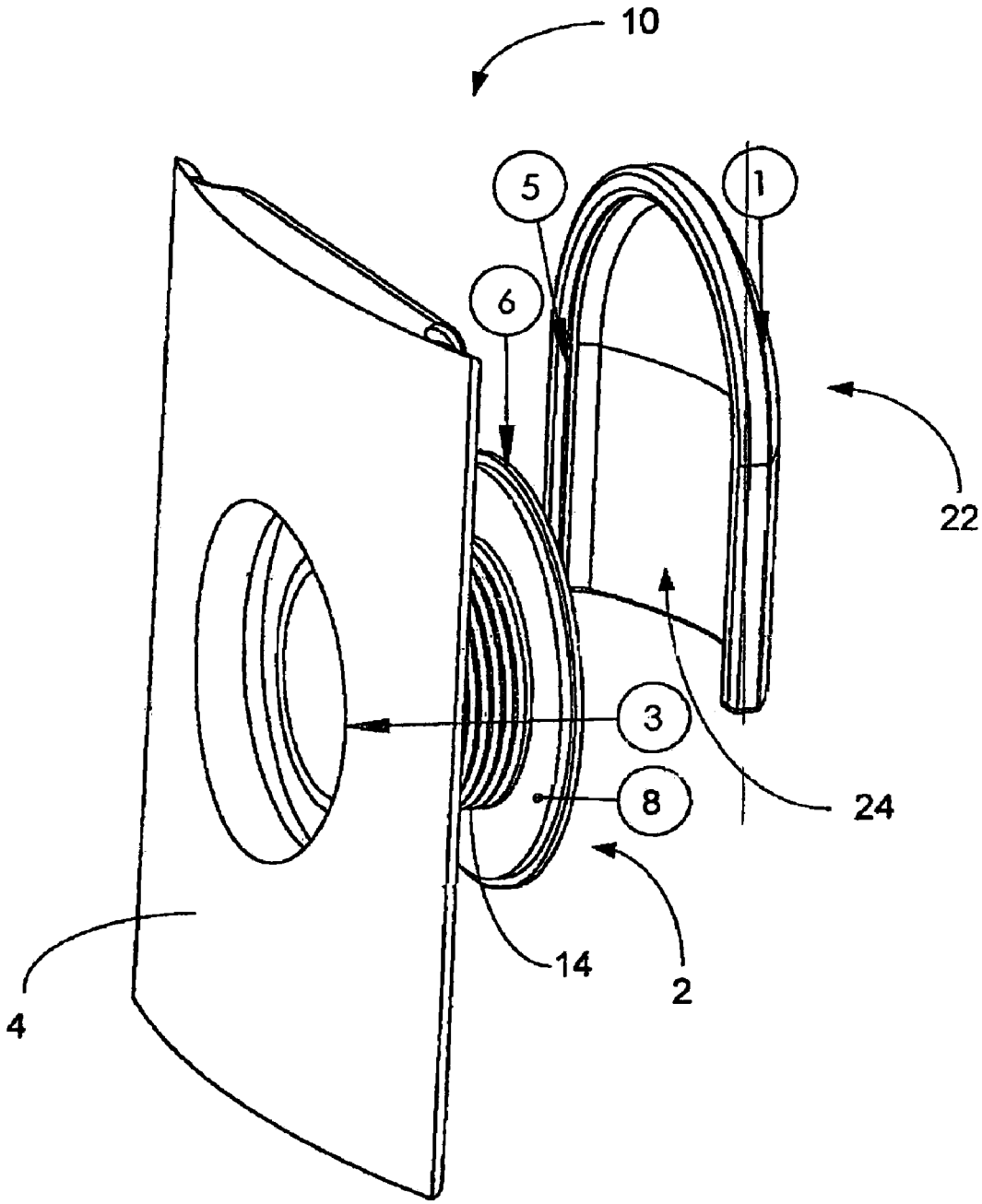
FIG. 1 is an exploded view of the overflow device assembly in accordance with an embodiment of the present invention.

Referring now to FIG. 1, an overflow device assembly 10 is shown in exploded form, according to one embodiment of the invention. The overflow device assembly 10 includes a tieplate 2 and a faceplate 1. Together, the tieplate 2 and the faceplate 1 are installed in an overflow hole 3 of a vessel wall 4. The vessel may be a bathtub or a sink (not shown). When installed, the overflow device assembly acts as an air relief vent and allows liquid to flow out of the overflow hole 3 in the vessel wall 4 and into a drain, rather than flow over the top of the vessel.

The tieplate 2 is comprised of a pipe 14 connected to a tieplate flange 8. The tieplate flange 8 is connected at an end of the pipe 14 opposite the vessel wall 4. Furthermore, a mating flange 6 may be attached to the end of the pipe 14, adjacent the tieplate flange 8. The mating flange 6 may be thinner than the tieplate flange 8. Furthermore, the mating flange 6 may have a diameter greater than the tieplate flange 8, as shown in FIG. 1. The end of the pipe 14 opposite the vessel wall 4 is open and allows air and liquid to pass into the overflow hole 3.

As also illustrated in FIG. 1, the faceplate 1 is separate from the tieplate 2. The faceplate 1 includes a front and a rear. The front of the faceplate 1 is considered the front cover portion 22. The rear of the faceplate 1 is considered the backside 24.

The backside 24 of the faceplate 1 includes a groove 5 along the outside of the faceplate 1. As illustrated in FIG. 1, the groove 5 is a slot located on the backside 24 of the faceplate 1 and opens inward to the interior of the backside 24 of the faceplate 1. Furthermore, the groove 5 does not go completely around the faceplate 1. For example, the groove 5 does not extend along the bottom of the backside 24 of the faceplate 1 in the preferred embodiment illustrated in FIG. 1. Accordingly, the bottom of the faceplate 1 may not have a groove 5.

When installed into a vessel, the tieplate flange 8 is mechanically coupled to the elbow or head fitting of the drain assembly (not shown) located behind the vessel wall 4. The tieplate 2 is located on the interior side of the vessel and the elbow is located on the opposite side. Both the elbow and the tieplate flange 8 are concentrically disposed over the overflow hole 3, on opposite sides of vessel wall 4. Once installed, the tieplate flange 8 may be flush against the vessel wall 4 (as seen in FIG. 2C), separating the mating flange 6 from the vessel wall 4 and forming a slot (not shown). In a preferred embodiment, the tieplate 2 is annular in shape and the tieplate flange 8 hugs the interior of the vessel wall 4. In such embodiments, some or the entire pipe 14 may pass through the overflow hole 3 (as seen in FIG. 2C) to mechanically couple the elbow or head fitting of the drain assembly located on the opposite side of the vessel wall 4.

In order to maintain a tight seal between the elbow and the vessel wall 4, a gasket (not shown) may be used. In a preferred embodiment, the pipe 14 may have male threads and the elbow may have female threads, such that the tieplate 2 is screwed into the elbow, with the overflow hole 3 in the vessel wall 4 and gasket (not shown) sandwiched in between. Once screwed in place, no additional hardware connecting the tieplate 2 to the vessel wall 4 is visible. This architecture allows for an aesthetically pleasing design.

Once the tieplate 2 is installed in the vessel wall 4, the faceplate 1 is mated with the tieplate 2 to form the overflow device assembly 10. The faceplate 1 is operable to slide onto the tieplate. The mating flange 6 of the tieplate 2 is operable to slide over and along the groove 5 on the backside 24 of the faceplate 1. Once installed, the front cover portion 22 of the faceplate 1 covers the end of the pipe 14. For example, as illustrated in FIG. 1, the faceplate 1 is operable to slide down over the mating flange 6, with the mating flange 12 guided along the groove 5. Once mated, the faceplate 1 rests on top of the mating flange 6, with the mating flange 6 inside the groove 5. In a preferred embodiment, the faceplate 1 is operable to slide along and into the slot formed between the mating flange 6 and the vessel wall 4.

As further illustrated in FIG. 1, the mating flange 6 and the groove 5 have complementary shapes such that the mating flange 6 fits inside the groove 5. In the embodiment illustrated in FIG. 1, the groove 5 is located along the perimeter of the backside 24 of the faceplate 1. Furthermore, as illustrated in the preferred embodiment, the groove 5 has a groove radius located at the semi-circular top portion of the faceplate 1 and two side grooves which are parallel to each other. Similarly, the mating flange 6 is circular and is designed with a semi-circular top having a top radius. As described above, the mating flange may be thinner and have a larger diameter than the tieplate flange 8. In the preferred embodiment shown in FIG. 1, the top radius of the mating flange 6 is substantially equal to the groove radius of the groove 5 such that the faceplate 1 is operable to slide along the mating flange 6. Once mated, the semi-circular top portion of the groove 5 rests on top of the semi-circular top of the mating flange 6. Furthermore, a portion of the backside 24 adjacent the semi-circular top portion of the groove 5 may be designed to rest on the tieplate flange 8; for example, in the slot between the mating flange 6 and the vessel wall 4.

Figure 2A:
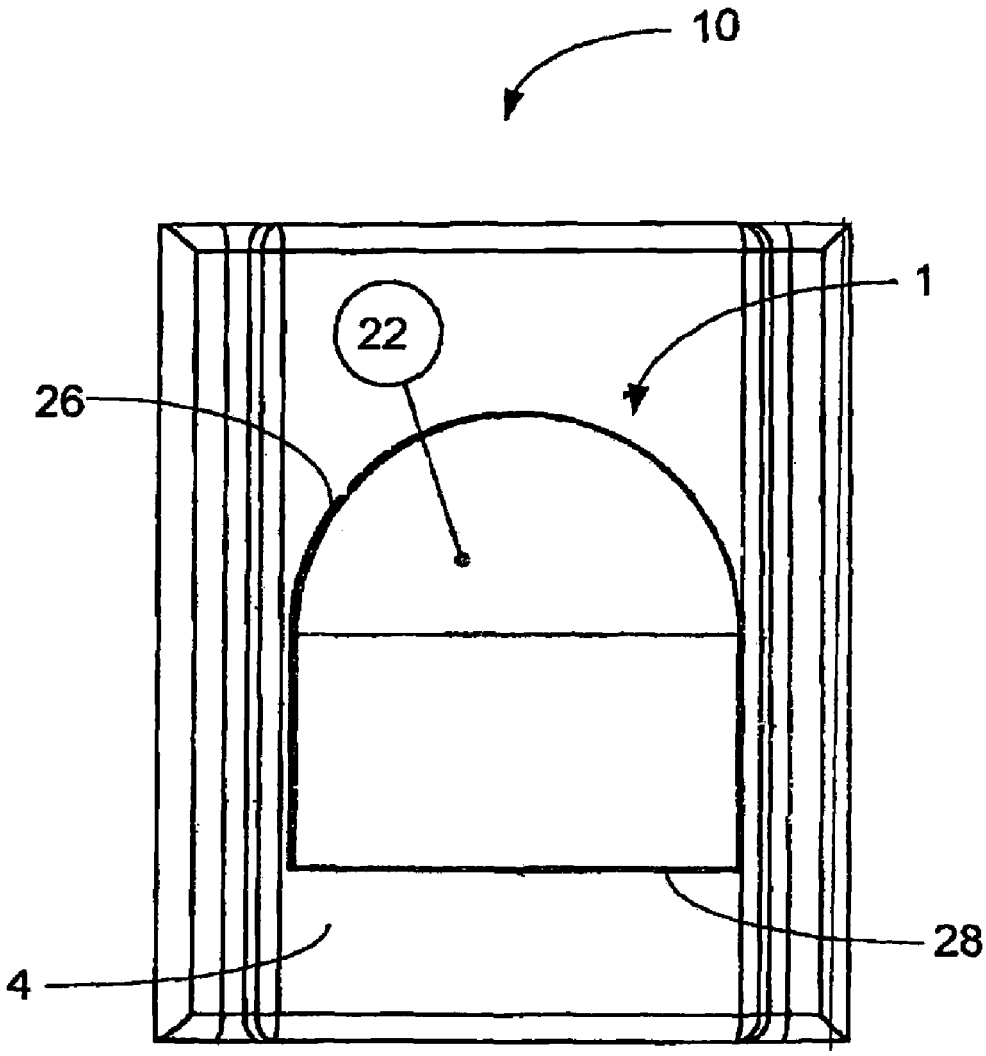
FIG. 2A is a frontal view of the overflow device assembly in accordance with an embodiment of the present invention.
Figure 2B:
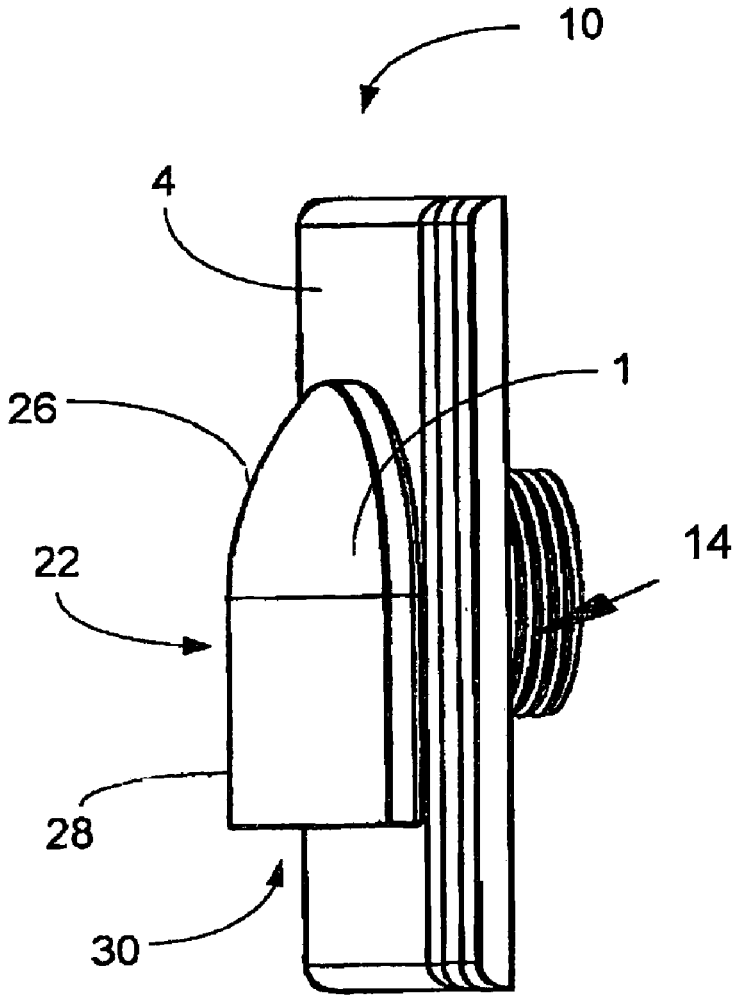
FIG. 2B is a side view of the overflow device assembly in accordance with an embodiment of the present invention.
Figure 2C:
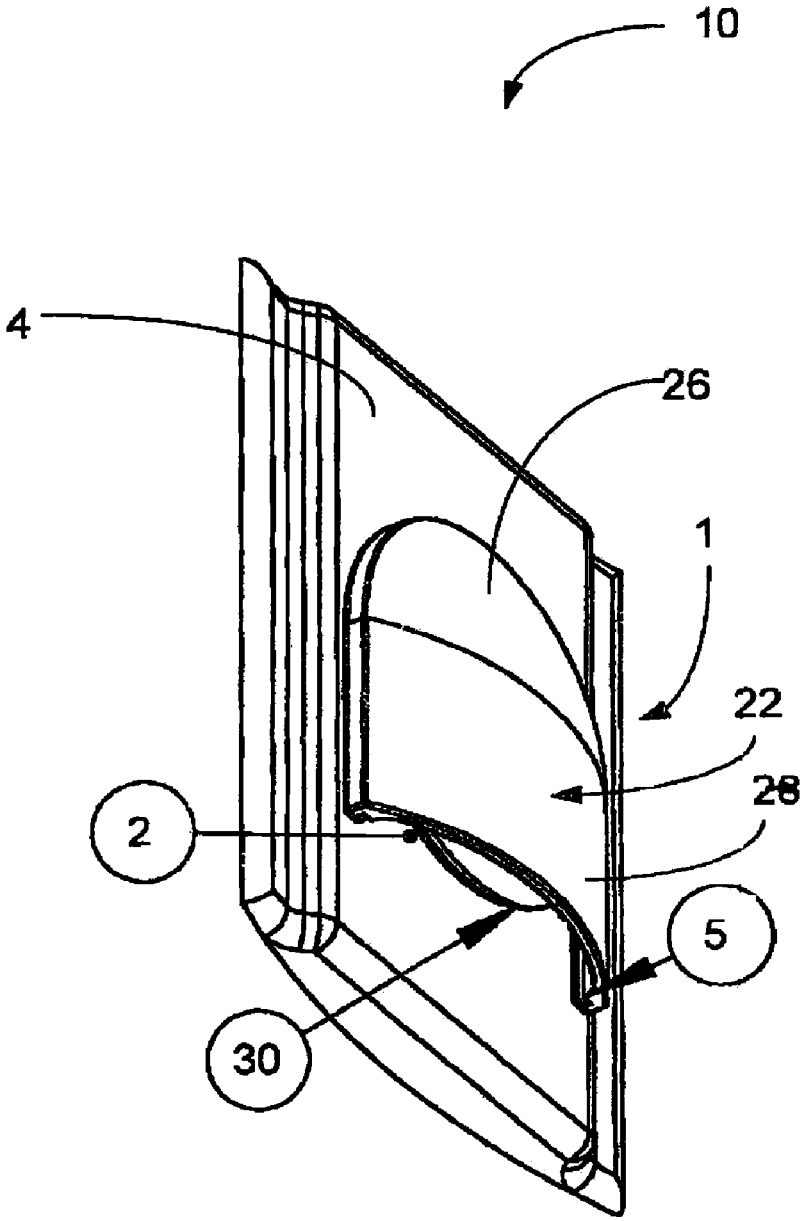
FIG. 2C is a perspective view from below of the overflow device assembly in accordance with an embodiment of the present invention.

Referring now to FIG. 2A, FIG. 2B and FIG. 2C, different views of the overflow device assembly 10 are shown when the faceplate 1 is mated with the tieplate 2.

FIG. 2A illustrates a frontal view of the overflow device assembly 10 when the faceplate 1 is mated with the tieplate 2. As illustrated in FIG. 2A, the tieplate (not shown) is completely hidden behind the front cover portion 22 of the faceplate 1.

In the preferred embodiment illustrated in FIG. 2A, only the faceplate 1 and the vessel wall 4 are visible. Accordingly, the faceplate 1 is capable of being decorated. While the faceplate 1 is shown as having a front cover portion 22 with a rounded top portion 26 and a rectangular bottom portion 28, other shapes are possible. For example, the entire faceplate 1 may be rectangular.

The front cover portion 22 may take on a variety of different finishes. For example, finishes may include in-mould decorating, conventional plating, mirror finishes, different textures and three-dimensional ornamentation.

Referring now to FIG. 2B, a side view of the overflow device 10 is shown in a preferred embodiment. As seen from the side, only the faceplate 1 is seen, as the tieplate (not shown) is completely obscured from view with the front cover portion 22 facing outwards from the vessel wall 4. FIG. 2B also shows the pipe 14 (which connects to an elbow fitting (not shown) behind the vessel wall 4, which is connected to the tieplate 2 on the opposite, interior, side of the vessel wall 4. As previously described, the elbow leads to the drain assembly (not shown).

FIG. 2B further illustrates that once mated to the tieplate 2 (as shown in FIG. 1), the periphery of the rounded top portion 26 and the parallel sides of the rectangular bottom portion 28 are flush with the vessel wall 4. However, the bottom of the faceplate 1 is not flush with the vessel wall 4. Instead, the bottom of the faceplate 1 provides a gap 30 (as better seen in FIG. 2C) to allow air and liquid to flow into the drain assembly via the tieplate 2 and the elbow 16.

Referring now to FIG. 2C, a perspective view of the overflow device assembly 10 is shown from below. As seen from below, the faceplate 1 is convex (concave up) from the perspective of the vessel wall 4, where the central portion of the front cover portion 22 provides a gap 30 between the tieplate 2 and the faceplate 1. Meanwhile, the two sides of the rectangular bottom portion 28 and the periphery of the rounded top portion 26, of the front cover portion 22, are flush with the vessel wall 4.

The gap 30 between the faceplate 1 and the tieplate 2 allows air and liquid to flow into the drain assembly via the hole in the tieplate 2, which leads to the drain assembly. In this manner, the overflow device assembly 10 is operable as an air relief vent and provides drainage in an overflow condition. Furthermore, in some embodiments, additional functionality can be added to the gap 30 between the faceplate 1 and the tieplate 2. For example, the gap 30 between the mating flange 6 and the faceplate 1 may be operable to house a drain stopper (not shown). Specifically, indentations in the tieplate 2 and/or backside 24 of the faceplate 1 may be operable to capture or house the ball of a chain and plug drain stopper (not shown).

The waste-overflow sub-assembly of a vessel drain assembly has an "elbow", also known as "head fitting", behind the bath or sink vessel, centered upon the overflow hole in the vessel wall. Between the vessel wall and the elbow is a gasket that prevents leakage of vessel liquid. In order to cinch this elbow and its sandwiched seal tight against the vessel wall, a part called the "tieplate" must be positioned on the opposite, interior, side of the vessel wall, again centered on the overflow hole. Any number of means is used to pull the the elbow tight to the part on the interior of the vessel, called the "faceplate". Bolts are most common.

In another embodiment, an annular faceplate with a male-threaded short pipe running from inner diameter of this ring is chosen, this male thread fitting into the female thread of the interior of the elbow. This architecture allows for an aesthetic cover plate-tieplate sub-assembly. The tieplate flange bears a thinner mating flange that is of a diameter such that the fitted slot in the rear interior of the faceplate fits over and down on the mating flange to rest with the semi-circular slot portion sitting on top of the semi-circular region of the tie-plate mating flange that is orientated topmost. The male-threaded pipe of the annular tieplate inserts into the vessel wall via the overflow hole in the same vessel wall.

The slot or groove in the faceplate fits over the tieplate mating flange by means of a gap on the underside of the faceplate. This enables the following functionalities:

1) No fastener necessary to attach the faceplate to the tieplate.
2) No horizontal member necessary to accept these fasteners, so the center of the tieplate can remain empty and allow for the passage of a plumber's snake.

The gap also performs two traditional functions of a faceplate:

1) Allows air pressure venting.
2) Allows for mitigation of the liquid overflow.

This very simple method of attaching a cosmetic faceplate to a tieplate is novel both in what it lacks, that is, a fastener and a central bar on the tieplate, as for what it gains, that is, a fitted slot-flange coupling and a smooth faceplate surface opportunity for decoration. Although the faceplate illustrated in the figures is rounded at the top, any shape would be possible, including rectangular. Functionality can be optionally added to the interior region of the sub-assembly, for example, indentations to capture the ball of a chain and plug drain stopper.

The invention claimed is:

1. An overflow device for a vessel having a wall with a hole therethrough, said overflow device comprising:

a tieplate having a pipe for extending through said hole;

a tieplate flange extending directly from said pipe about a first end of said pipe for engaging said wall about said hole;

a mating flange extending outwardly from said tieplate flange; and a faceplate slidable over said tieplate in a direction transverse to said pipe, said faceplate having a front cover portion, a backside opposite said front cover portion and a groove in said backside for receiving said mating flange and allowing said faceplate to be slid over said tieplate until said front cover portion covers said first end of said pipe;

wherein said groove covers said mating flange and limits movement of said faceplate relative to said tieplate in said transverse direction; and wherein said faceplate provides a gap between said first end of said pipe and said faceplate to provide fluid access to said first end of said pipe.

2. The overflow device of claim 1 wherein said tieplate has a second end opposite said first end for coupling with an elbow of a drain assembly.

3. The overflow device of claim 2 wherein said second end has threads for threadedly engaging said elbow.

4. The overflow device of claim 3 wherein said threads are external threads.

5. The overflow device of claim 4 wherein said mating flange has a semi-circular top and said groove comprises a semi-circular top portion which receives said semi-circular top of said mating flange.

6. The overflow device of claim 1, wherein said tieplate flange is at said first end of said pipe.

7. The overflow device of claim 1, wherein said pipe is threaded.

8. The overflow device of claim 6, wherein said pipe is threaded.

* * * * *

UNITED STATES PATENT AND TRADEMARK OFFICE

CERTIFICATE OF CORRECTION

PATENT NO. : 8,266,735 B2
APPLICATION NO. : 12/270876
DATED : September 18, 2012
INVENTOR(S) : McLeod It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 500 days.

Signed and Sealed this
Sixteenth Day of September, 2014

Michelle K. Lee

Michelle K. Lee
*Deputy Director of the United States Patent and Trademark Office*